US011395549B2

(12) United States Patent
Brown et al.

(10) Patent No.: US 11,395,549 B2
(45) Date of Patent: Jul. 26, 2022

(54) DRIVE MECHANISM

(71) Applicant: EEVOLV LTD, Cheltenham (GB)

(72) Inventors: Paul Brown, Cheltenham (GB); Dale Robertson, Cheltenham (GB)

(73) Assignee: EEVOLV LTD, Gloucestershire (GB)

( * ) Notice: Subject to any disclaimer, the term of this patent is extended or adjusted under 35 U.S.C. 154(b) by 0 days.

(21) Appl. No.: 17/266,950

(22) PCT Filed: Aug. 9, 2019

(86) PCT No.: PCT/EP2019/071490
§ 371 (c)(1),
(2) Date: Feb. 8, 2021

(87) PCT Pub. No.: WO2020/030806
PCT Pub. Date: Feb. 13, 2020

(65) Prior Publication Data

US 2021/0298478 A1 Sep. 30, 2021

(30) Foreign Application Priority Data

Aug. 9, 2018 (GB) ..... 1813009

(51) Int. Cl.
*A47C 1/02* (2006.01)
*A47C 1/034* (2006.01)

(52) U.S. Cl.
CPC ..... *A47C 1/0345* (2013.01)

(58) Field of Classification Search
CPC ..... A47C 1/0345; A47C 1/03294
See application file for complete search history.

(56) References Cited

U.S. PATENT DOCUMENTS 139,493 A 6/1873 Bray
638,466 A 12/1899 Kelly
(Continued)

FOREIGN PATENT DOCUMENTS

CA 851 402 9/1970
CA 851402 9/1970
(Continued)

OTHER PUBLICATIONS

PCT/EP2019/071490, International Search Report and Written Opinion, dated Oct. 22, 2019, 14 pages—English.
(Continued)

*Primary Examiner* — Shin H Kim
(74) *Attorney, Agent, or Firm* — Andrew F. Young; Nolte Lackenbach Siegel

(57) ABSTRACT

A drive mechanism for an article of adjustable furniture, the drive mechanism having support sections, the support sections including a first support section and a second support section, an actuator mechanism, and at least one connecting mechanism, the at least one connecting mechanism includes a first arm pivotally connected to the first support section, and a second arm pivotally connected to the second support section, the first arm being pivotally connected to the second arm, in which the actuator mechanism is drivingly connected to the second support section to effect concertina-like movement between the first arm and the second arm to move the second support section relative to the first support section.

16 Claims, 17 Drawing Sheets

(56) References Cited

U.S. PATENT DOCUMENTS

Figure 1:
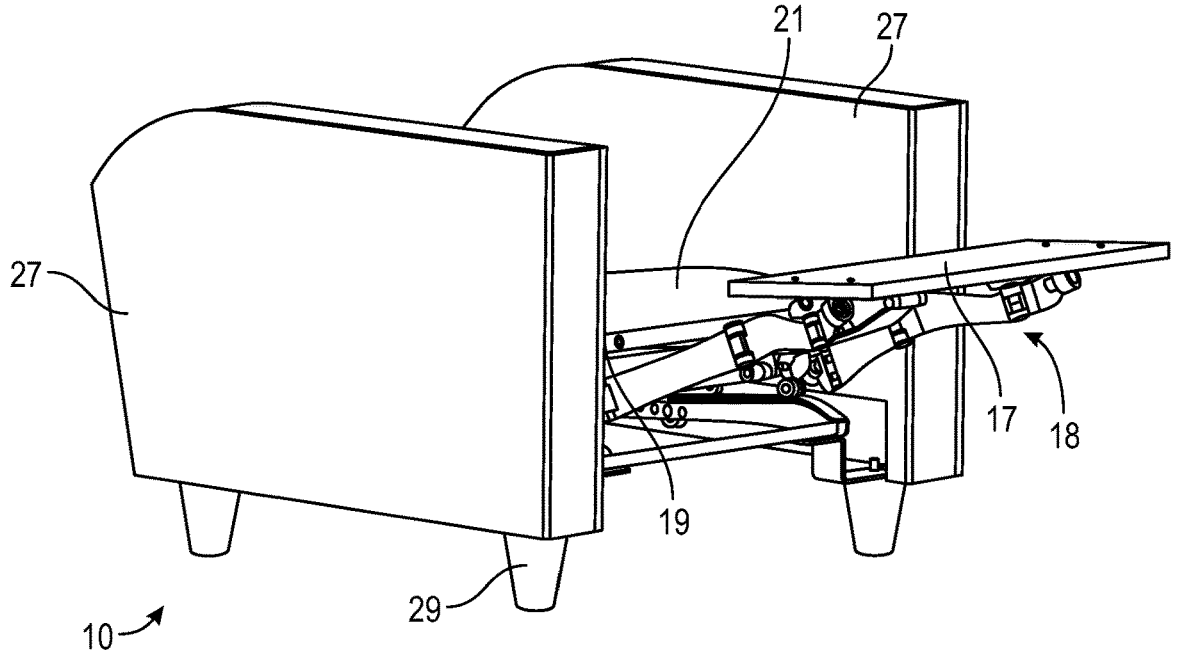

| | | | | |
|---|---|---|---|---|
| 912,214 | A | 2/1909 | Ward | |
| 1,238,078 | A | 8/1917 | Ault | |
| 1,414,637 | A | 5/1922 | Gell | |
| 2,497,395 | A | 2/1950 | Cramer, Sr. | |
| 2,859,797 | A | 11/1958 | Mitchelson | |
| 2,954,072 | A | 9/1960 | Fossati | |
| 3,036,862 | A | 5/1962 | Beierbach et al. | |
| 3,086,814 | A | 4/1963 | Fletcher | |
| 3,121,589 | A | 2/1964 | Schliephacke | |
| 3,202,453 | A | 8/1965 | Richards | |
| 3,281,141 | A | 10/1966 | Smiley et al. | |
| 3,369,767 | A | 2/1968 | Greenfield | |
| 3,690,723 | A | 9/1972 | McClain et al. | |
| 3,743,349 | A | 7/1973 | McDonald et al. | |
| 3,797,050 | A | 3/1974 | Benot et al. | |
| 3,847,430 | A | 11/1974 | Fletcher | |
| 3,858,932 | A * | 1/1975 | Crum | A47C 1/0345 297/85 R |
| 3,873,152 | A | 3/1975 | Garas | |
| 4,202,062 | A | 5/1980 | Marcyan | |
| 4,212,495 | A | 7/1980 | Gall | |
| 4,332,417 | A | 6/1982 | Mizelle | |
| 4,423,903 | A * | 1/1984 | Gerth | A47C 1/0345 297/68 |
| 4,547,017 | A | 10/1985 | Lescure | |
| 4,635,999 | A | 1/1987 | Simpson | |
| 4,740,031 | A * | 4/1988 | Rogers, Jr. | A47C 1/0345 297/232 |
| 4,852,939 | A * | 8/1989 | Krauska | A47C 1/0242 297/71 |
| 4,970,737 | A | 11/1990 | Sagel | |
| 4,996,731 | A | 3/1991 | Kruyt | |
| 5,112,109 | A | 5/1992 | Takada et al. | |
| 5,246,266 | A | 9/1993 | Ostergaard | |
| 5,469,591 | A | 11/1995 | Nomura | |
| 5,625,913 | A | 5/1997 | Singleton | |
| 5,640,730 | A | 6/1997 | Godette | |
| 5,785,384 | A | 7/1998 | Sagstuen | |
| 5,819,345 | A | 10/1998 | Basgall | |
| 5,845,961 | A * | 12/1998 | LaPointe | A47C 1/0345 297/75 |
| 5,862,551 | A | 1/1999 | Oguma et al. | |
| 5,897,462 | A | 4/1999 | St. Germain | |
| 6,059,364 | A | 5/2000 | Dryburgh et al. | |
| 6,059,367 | A * | 5/2000 | Rogers | A47C 3/0255 297/423.1 |
| 6,101,648 | A | 8/2000 | Sommerfeld et al. | |
| 6,343,392 | B1 | 2/2002 | Becker et al. | |
| 6,568,755 | B1 | 5/2003 | Groening | |
| 6,641,214 | B2 | 11/2003 | Veneruso | |
| 6,692,078 | B2 * | 2/2004 | Pham | A47C 1/0342 297/423.19 |
| 6,739,661 | B1 | 5/2004 | Dukes | |
| 7,219,958 | B2 | 5/2007 | Yamazaki et al. | |
| 7,390,060 | B2 | 6/2008 | Kristen | |
| 7,445,279 | B2 | 11/2008 | Crum | |
| 7,641,277 | B2 | 1/2010 | Lawson et al. | |
| 7,703,851 | B2 | 4/2010 | Nakaya et al. | |
| 7,997,654 | B2 | 8/2011 | Ferry et al. | |
| 8,303,036 | B2 | 11/2012 | Hankinson et al. | |
| 8,403,415 | B2 | 3/2013 | Lawson | |
| 8,424,964 | B2 | 4/2013 | Campbell et al. | |
| 8,534,758 | B2 | 9/2013 | Rivera | |
| 8,926,009 | B1 | 1/2015 | Lapointe | |
| 9,155,388 | B2 | 10/2015 | Robertson | |
| 9,808,385 | B2 | 11/2017 | Robertson | |
| 10,004,334 | B2 | 6/2018 | Robertson | |
| 2002/0060483 | A1 | 5/2002 | Yoshida et al. | |
| 2002/0162170 | A1 | 11/2002 | Dewert | |
| 2002/0174487 | A1 | 11/2002 | Kramer et al. | |
| 2003/0075965 | A1 * | 4/2003 | Pham | A47C 1/0342 297/423.19 |
| 2003/0172455 | A1 | 9/2003 | Roma et al. | |
| 2004/0155504 | A1 | 8/2004 | Tada | |
| 2004/0232741 | A1 | 11/2004 | Kristen | |
| 2005/0023869 | A1 * | 2/2005 | Longnecker | A47C 1/0345 297/125 |
| 2005/0210588 | A1 | 9/2005 | Loewenthal | |
| 2006/0143827 | A1 | 7/2006 | Wilming et al. | |
| 2006/0225201 | A1 | 10/2006 | Kristen | |
| 2007/0120409 | A1 | 5/2007 | Leeds | |
| 2007/0158980 | A1 | 7/2007 | LaPointe et al. | |
| 2007/0174487 | A1 | 7/2007 | Busey | |
| 2008/0150329 | A1 | 6/2008 | Lawson | |
| 2008/0258512 | A1 | 10/2008 | Rogers | |
| 2009/0044339 | A1 | 2/2009 | Morin et al. | |
| 2009/0178201 | A1 | 7/2009 | Leonard et al. | |
| 2011/0175422 | A1 | 7/2011 | Bruck | |
| 2011/0248530 | A1 | 10/2011 | Sartisohn | |
| 2012/0240337 | A1 | 9/2012 | Shih | |
| 2014/0041121 | A1 | 2/2014 | Shan | |
| 2014/0103688 | A1 | 4/2014 | Wilson | |
| 2015/0028646 | A1 | 1/2015 | Lapointe | |
| 2016/0058191 | A1 | 3/2016 | Hegedus et al. | |
| 2021/0298478 | A1 * | 9/2021 | Brown | A47C 1/0345 |

FOREIGN PATENT DOCUMENTS

| | | |
|---|---|---|
| CA | 2552475 | 7/2004 |
| CH | 597799 | 10/1975 |
| CN | 202314169 | 7/2012 |
| DE | 19508907 | 10/1996 |
| DE | 029715343 | 1/1998 |
| DE | 010152227 | 5/2003 |
| DE | 20 2003 015 235 | 1/2006 |
| DE | 20 2005 015 275 | 1/2006 |
| DE | 20 2007 009 068 | 12/2007 |
| DE | 10 2007 024 218 | 11/2008 |
| DE | 102007024218 | 11/2008 |
| DE | 10 2007 049 118 | 2/2009 |
| DE | 202013003190 U1 | 4/2013 |
| EP | 0781518 | 12/1996 |
| EP | 0 774 223 | 5/1997 |
| EP | 0865960 | 3/1998 |
| EP | 0865960 | 9/1998 |
| EP | 1 114 597 | 7/2001 |
| EP | 1 306 032 | 10/2002 |
| EP | 1285606 | 2/2003 |
| EP | 1 537 805 | 12/2004 |
| EP | 1 537 805 | 6/2005 |
| EP | 1613195 | 1/2006 |
| EP | 1 621 175 | 2/2006 |
| EP | 2 524 623 | 11/2012 |
| FR | 2780256 | 6/1998 |
| FR | 2911485 | 1/2007 |
| GB | 0329834 | 5/1930 |
| GB | 0414464 | 8/1934 |
| GB | 0775679 | 5/1957 |
| GB | 2 085 719 | 8/1980 |
| GB | 2227932 | 8/1990 |
| GB | 2418846 | 12/2006 |
| GB | 2472920 | 2/2011 |
| GB | 2486335 | 6/2012 |
| GB | 2472920 | 2/2014 |
| GB | 191322022 | 8/2014 |
| GB | 2520430 | 11/2015 |
| GB | 0101239 | 8/2016 |
| JP | 36-13946 | 5/1936 |
| JP | 01214308 | 8/1989 |
| JP | 08-173263 | 7/1996 |
| JP | 08-308680 | 11/1996 |
| JP | 11-244096 | 9/1999 |
| JP | 2003-144262 | 5/2003 |
| SE | C2 510 584 | 6/1999 |
| WO | WO 96/29970 | 10/1996 |
| WO | WO2004107916 | 12/2004 |
| WO | WO 2005/051128 | 6/2005 |
| WO | WO 2005/107533 | 11/2005 |
| WO | WO 2006/023447 | 3/2006 |
| WO | WO 2007/124067 | 11/2007 |
| WO | WO 2008/129565 | 10/2008 |
| WO | WO 2008/132481 | 11/2008 |
| WO | WO/2011/021002 | 2/2011 |

(56) References Cited

FOREIGN PATENT DOCUMENTS

| | | |
|---|---|---|
| WO | WO 2011/021002 | 2/2011 |
| WO | WO2011/048384 | 4/2011 |
| WO | WO 2012/032305 | 3/2012 |
| WO | WO 2012/099061 | 7/2012 |
| WO | WO 2013/061259 | 5/2013 |
| WO | WO 2013/160758 | 10/2013 |
| WO | WO 2014/183112 | 11/2014 |
| WO | WO 201/5011432 | 9/2015 |
| WO | WO2016/058949 | 4/2016 |

OTHER PUBLICATIONS

EP Appln. No. 08 737 140.7, European Search Report dated Jan. 6, 2018, 4 pages—Englsih.
PCT/GB2017/051732, International Preliminary Report on Patentability and Written Opinion, dated Dec. 18, 2018, 8 pages—English.
CN 201680014490.8, Office Action dated May 8, 2019, 8 pgs.—English, 8 pgs.—Chinese.
GB1709407.9, Examination Report, dated May 8, 2019, 4 pgs.—English.
GB1709407.9, Office Action dated Dec. 17, 2019, 3 pgs.—English.
U.S. Appl. No. 15/557,192, Office Action dated Feb. 3, 2020, 24 pages—English.
GB 1316684.8, Search Report and Written Opinion, dated Mar. 13, 2014, 7 pages—English.
PCT/GB20I5/000315, International Search Report and Written Opinion, dated Jul. 3, 2016, 9 pages—English.
GB1422032.1, Search Report dated Apr. 29, 2015, 2 pages—English.
GB1319926.0 Search Report dated May 1, 2014, 4 pages—English.
GB1419811.3 Search Report dated Dec. 17, 2014, 7 pages—English.
PCT/GB2014/000452 Search Report and Written Opinion, 9 pages—English.
PCT/GB2015/000314, Search Report and Written Opinion, dated Jul. 3, 2016, 9 pages.
PCT/GB2017/051722, Search Report and Written Opinion dated Sep. 5, 2017, 17 pgs.—English.
Pat. No. GB 1417108.6, Combined Search and Examination Report dated Mar. 26, 2015, 7 pages—English.
EasyCliner® wood-to-the-floor recliner mechanism, 1 page, HomeFurnitureComponents.com, Apr. 10, 2015.
GB1313002.6, Search Report dated Jan. 21, 2014, 4 pages.
PCT/GB2014/000274, Written Opinion dated Jan. 21, 2014, 5 pages.
U.S. Appl. No. 13/390,985, filed Feb. 17, 2012, Office Action dated Jan. 7, 2015, 20 pages.
PCT/GB2010/001565 International Search Report dated Apr. 12, 2011, 6 pages—English.

* cited by examiner

DRIVE MECHANISM

CROSS REFERENCE TO RELATED APPLICATIONS

This application relates to and claims priority as a § 371 national phase, from PCT/EP2019/071490 filed Aug. 9, 2019, the entire contents of which are incorporated herein by reference, which in turn claims priority to GB 1813009.6 filed Aug. 9, 2018.

FIGURE SELECTED FOR PUBLICATION

FIG. 5.

The present invention relates to a drive mechanism for use with an article of adjustable furniture such as a chair or a bed, and in particular concerns adjustable furniture having one or more support sections which can be moved to adjust the configuration of the furniture.

Known articles of adjustable furniture comprise complex drive mechanisms driven by one or more actuators between different configurations. An example of such an article of furniture is described in U.S. Pat. No. 3,858,932.

The problem which such drive mechanism is that they are complex, heavy, contain multiple linkages, and are prone to fail and deliver poor performance. Such known mechanisms are also difficult to apply a coating for protection, and slow to assemble both as a mechanism, and when fixing the mechanism to the article of furniture. Finally, such known complex mechanisms contain multiple pinch points, requiring the furniture to incorporate additional safety features to protect the occupant.

Furthermore, known mechanisms occupy a large amount of space within the envelope defined by the furniture, leaving little space to for mechanisms to provide additional functionality, and limiting the space to provide thicker padding for the occupant which is becoming an increasing requirement.

A further problem associated with known designs is the rigidity of the support section when under the weight of a user. For example, a footrest section of the bed is vulnerable to the weight of the user and can require additional bracing to increase the rigidity.

There is therefore a requirement for an adjustable article of furniture which addresses the aforementioned problems associated with known designs, which is at least as easy to manufacture, store, transport, deliver and assemble as non-adjustable furniture of known designs.

Thus, according to one aspect of the present invention there is provided a drive mechanism for an article of adjustable furniture, the drive mechanism comprising a plurality of support sections, said support sections including a first support section and a second support section, an actuator mechanism, and at least one connecting mechanism, the at least one connecting mechanism includes a first arm pivotally connected to the first support section, and a second arm pivotally connected to the second support section, the first arm being pivotally connected to the second arm, in which the actuator mechanism is drivingly connected to the second support section to effect concertina-like movement between the first arm and the second arm to move the second support section relative to the first support section.

Advantageously, the concertina-like movement of the first and second arms enables the second support to be moved relative to the first support in a simple and compact manner, in contrast to the complex and large linkage mechanisms used to move support sections relative to each other in prior art articles of furniture.

The compact nature of the connecting mechanism, both in height and in depth, frees up space to incorporate additional second mechanisms into the article of furniture to provide further functionality, for example, in the case of a chair, a mechanism to lift the seat of the chair from the ground to enable the occupant to more easily enter and exit the seat, such a chair commonly known in the furniture industry as a high-lift chair. Other additional mechanisms to provide zero-wall, rocker, slide, and glide functionality, alone, or in combination can also be incorporated into the article of furniture.

Additionally or alternatively, the compact connecting mechanism provides more freedom in the aesthetic design of the chair, so that, for example, chairs with high legs can be used so as to resemble more conventional furniture. In such chairs, the connecting mechanism can be secured inside the chair above the legs, and therefore not visible when the chair is in use.

Preferably the concertina-like movement between the first arm and the second arm causes relative linear or coordinated simultaneous linear and rotational movement between the first and second support sections. Such coordinated movement enable the second support section to be driven linearly between first retracted and second extended positions, and at the same time rotate, so that an occupant of the furniture is comfortably supported on the second support section.

Preferably the second arm is pivotally connected to the second support section at a second arm pivotal connection to define a second arm extension section with a wheel at its free end, with the wheel engaging underneath the second support section to cause its rotation relative to the first support section.

Preferably the drive mechanism further comprises a block pivotally attached to the second support section, with the second arm also pivotally connected to the block such that the second arm pivotally connects to the second support section via the block about a first and second axis to cause the coordinated simultaneous linear and rotational movement of the second support section relative to the first support section.

Preferably the first arm and the second arm pivot substantially parallel to a plane defined by the first support section. Such an arrangement enables the first and second arms to be retained within a small vertical envelope during movement.

Preferably the first arm and the second arm pivot in a lateral direction as the actuator mechanism drives the second support section from a first retracted position towards a second extended position. This is advantageous compared to prior art mechanisms which do not pivot in the lateral direction, typically they pivot in the longitudinal and vertical directions, and thus occupy more space.

Preferably the drive mechanism further comprises a drive arm which connects the first and second support sections, with the drive arm having a first drive arm and a second drive arm pivotally connected to each other, the first drive arm being pivotally connected to the first support section and the second drive arm being pivotally connected to the second support section such that movement of the actuator mechanism effects concertina-like movement between the first drive arm and the second drive arm when the second support section moves relative to the first support section.

This has the advantage that an actuator of shorter stroke can be used when compared to an actuator connected directly to the second support section.

Preferably the first arm is pivotally connected to the first support section at a first arm pivot point to define a first arm extension section and the concertina-like movement between the first arm and the second arm causes a wheel at the free end of the first arm extension to engage with the first support section. Advantageously, this arrangement provides a reaction between the wheel and the first support section to support the second support section relative to the first support section as it extends and retracts.

According to another aspect of the present invention there is provided an article of furniture comprising a drive mechanism and a second mechanism to provide the furniture with a second functionality.

Preferably the second mechanism is one or more of a zero-wall mechanism, a glider mechanism, a rocker mechanism, or a lift-chair mechanism to provide the furniture with the second functionality.

Preferably the second mechanism is releasable attachable to the drive mechanism. This enables additional functionality to be added to the furniture by connecting the second mechanism to the first mechanism.

Preferably the actuator mechanism is a single linear drive electric actuator. Other actuator mechanisms can also be used such as a gas-strut actuator, or a constant spring force actuator.

Figure 2:
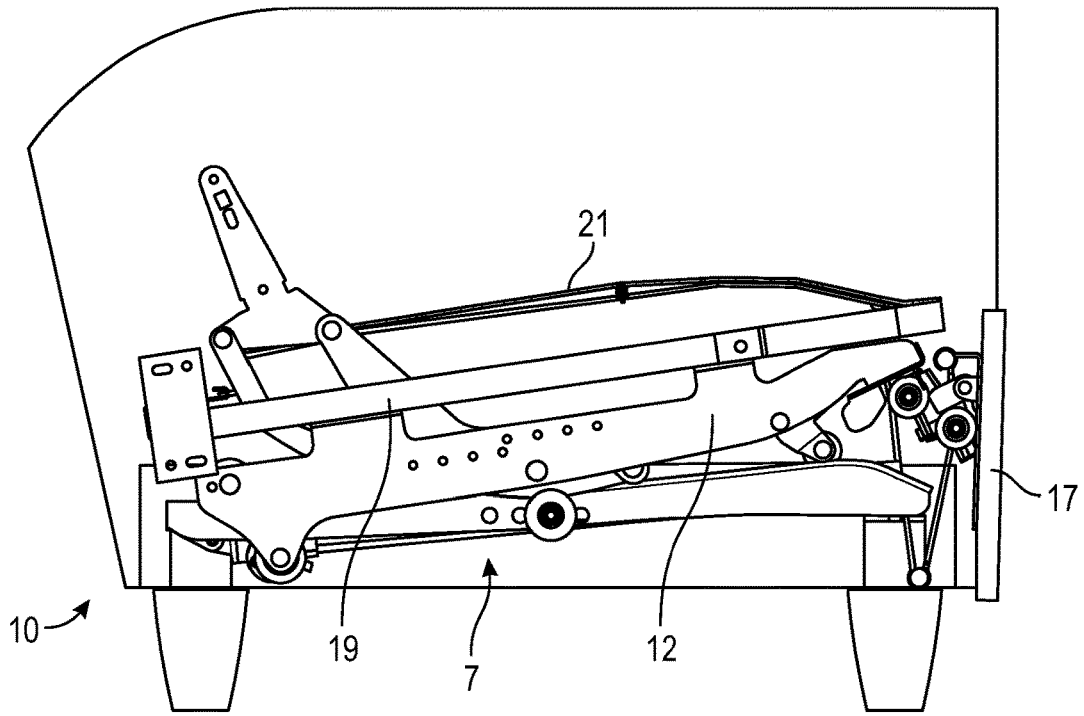
Figure 3:
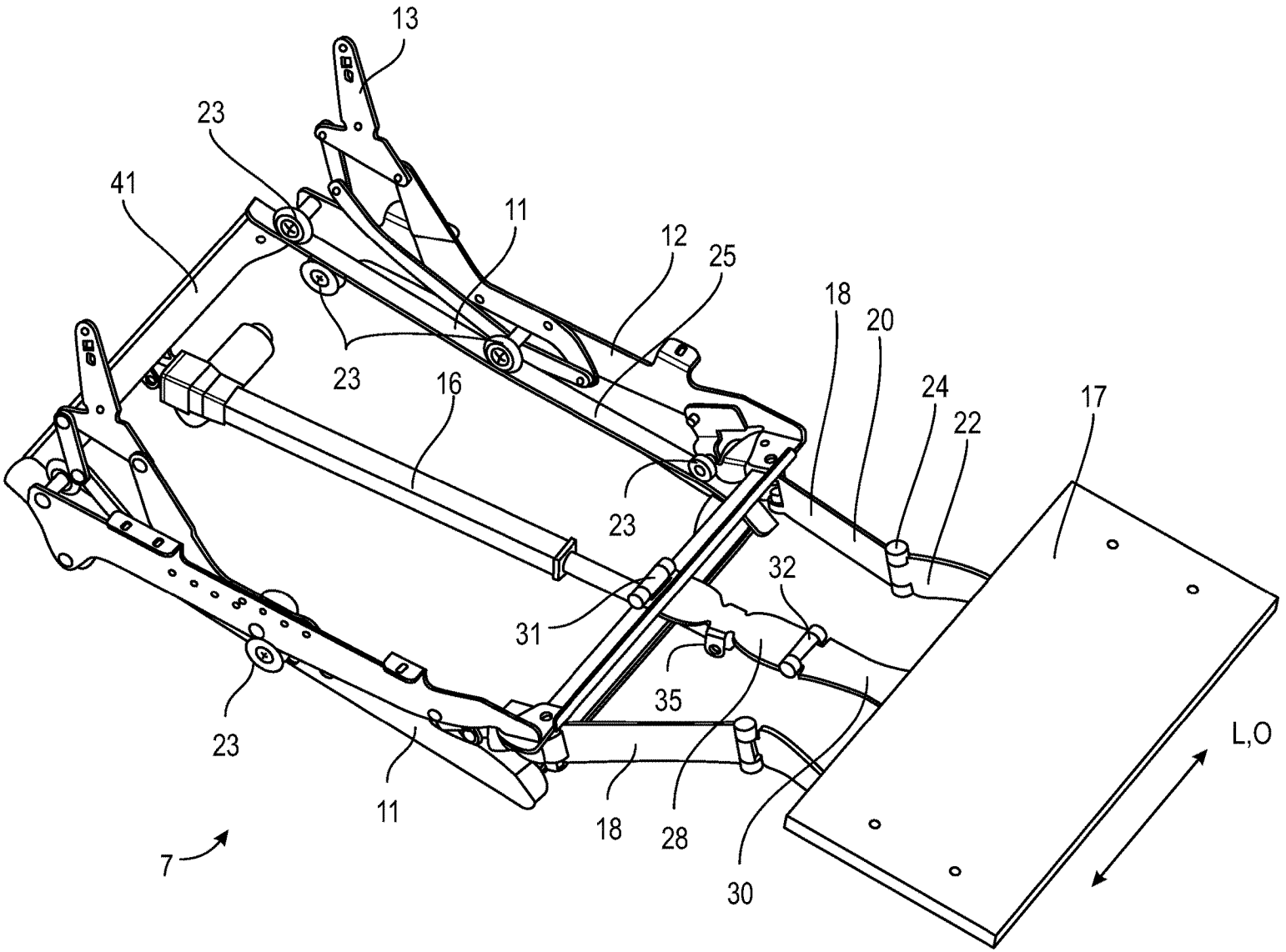
Figure 4:
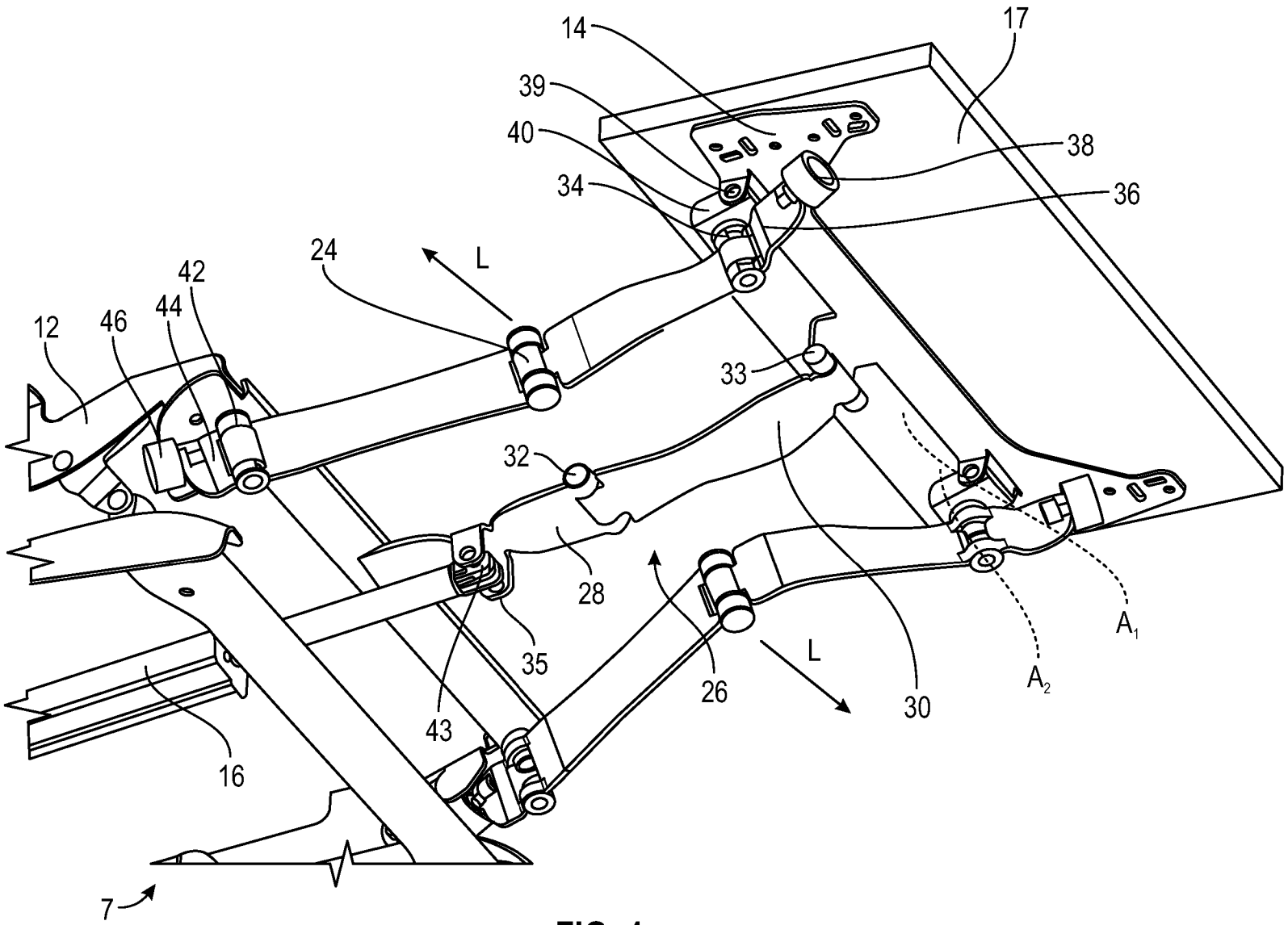
Figure 5:
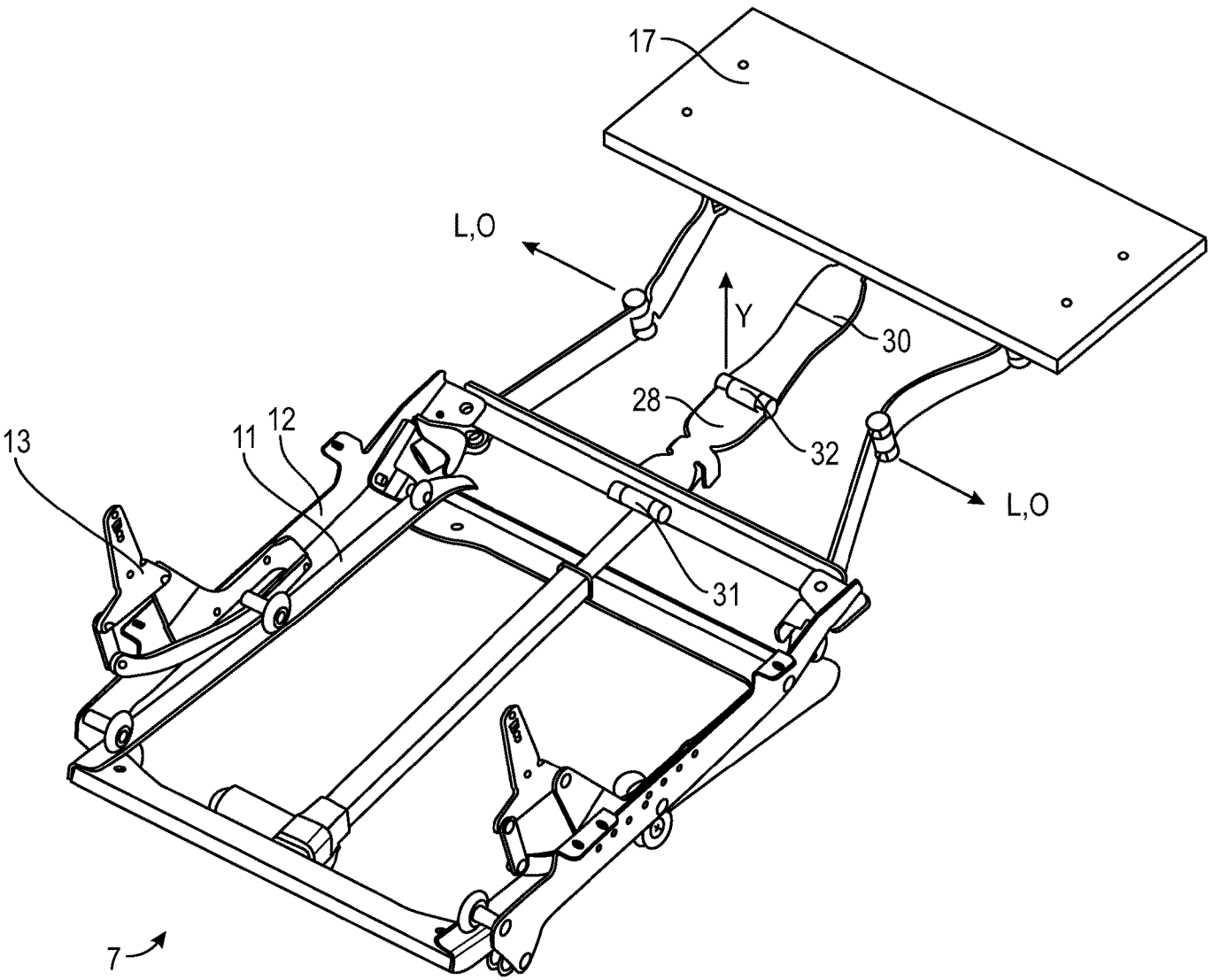
Figure 6:
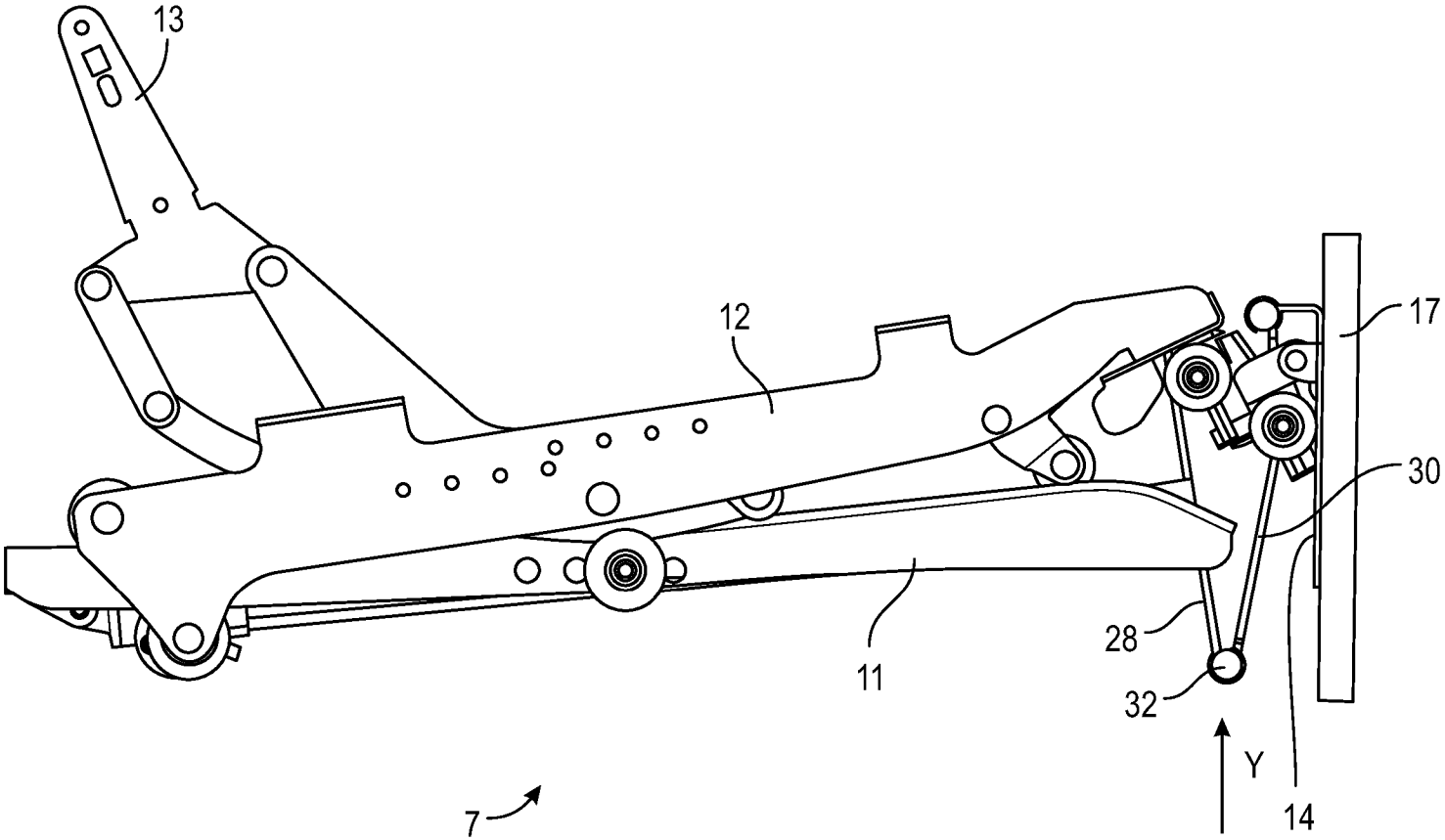
Figure 7:
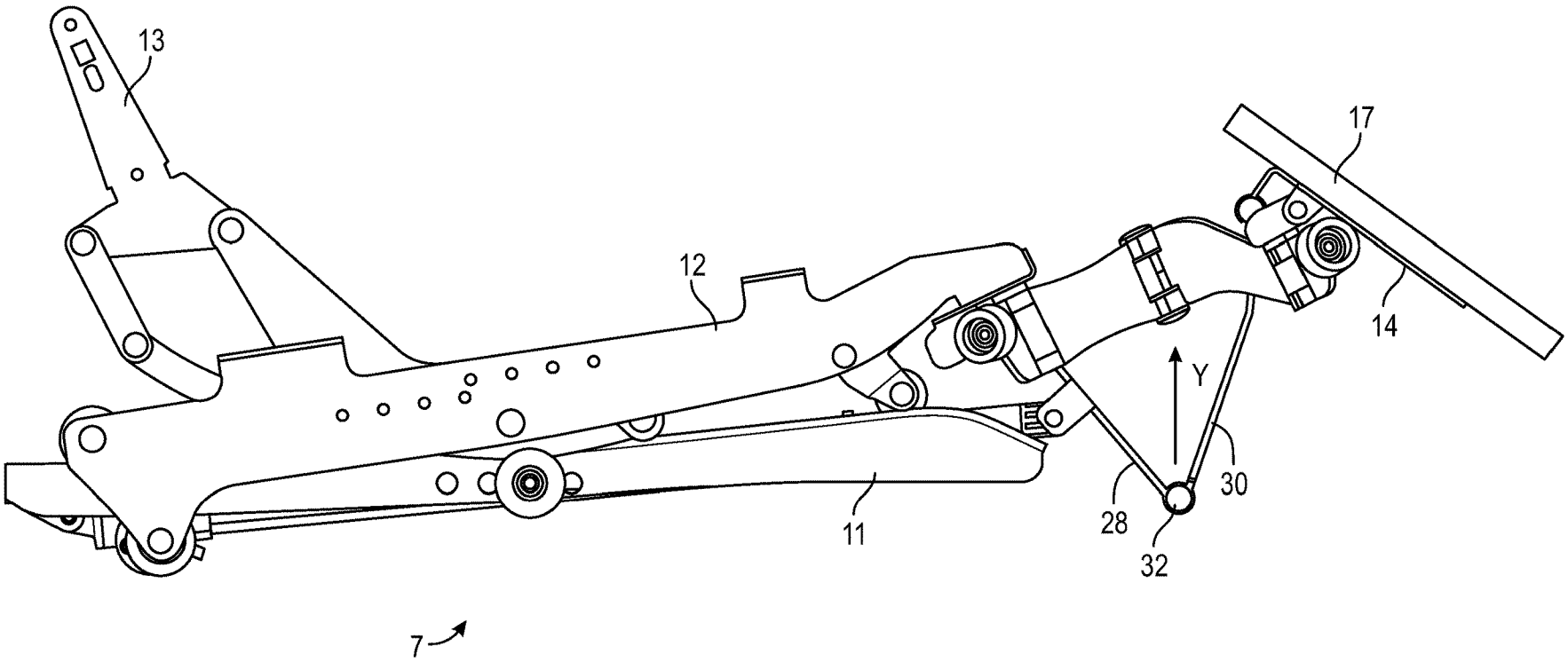
Figure 8:
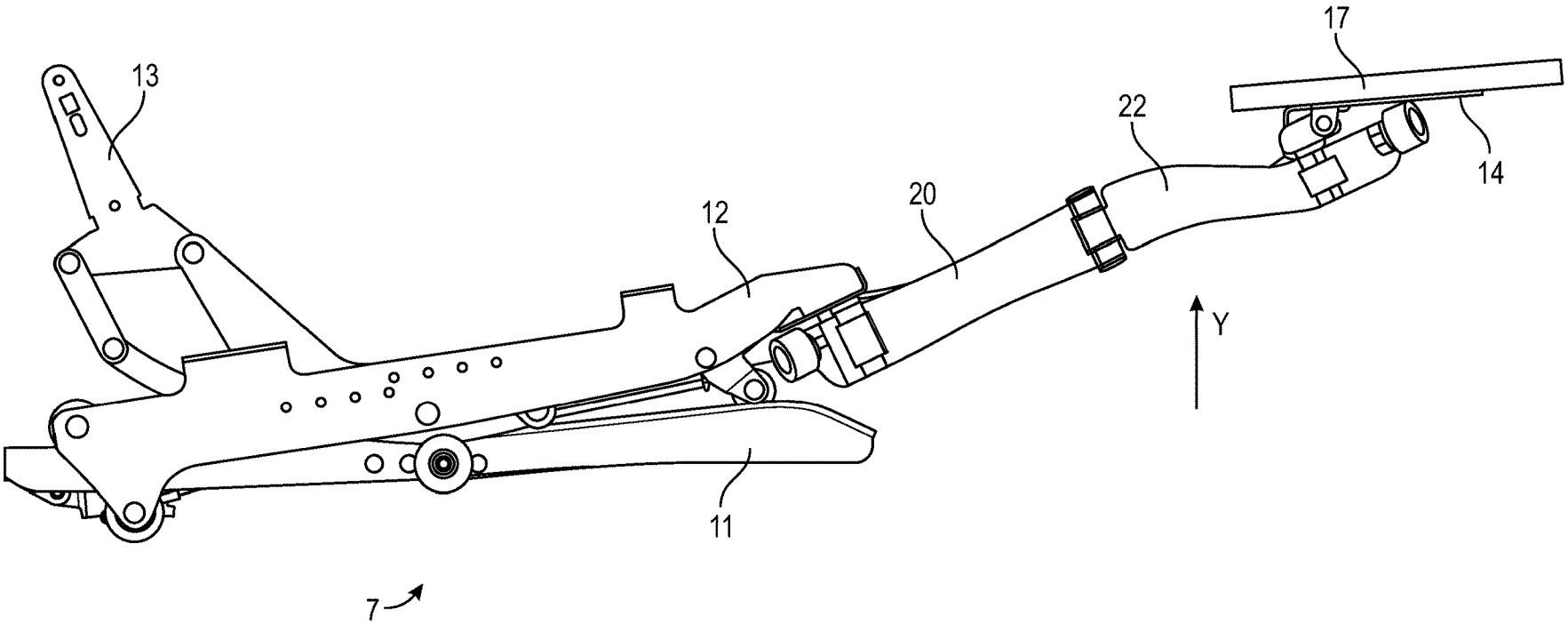
Figure 9:
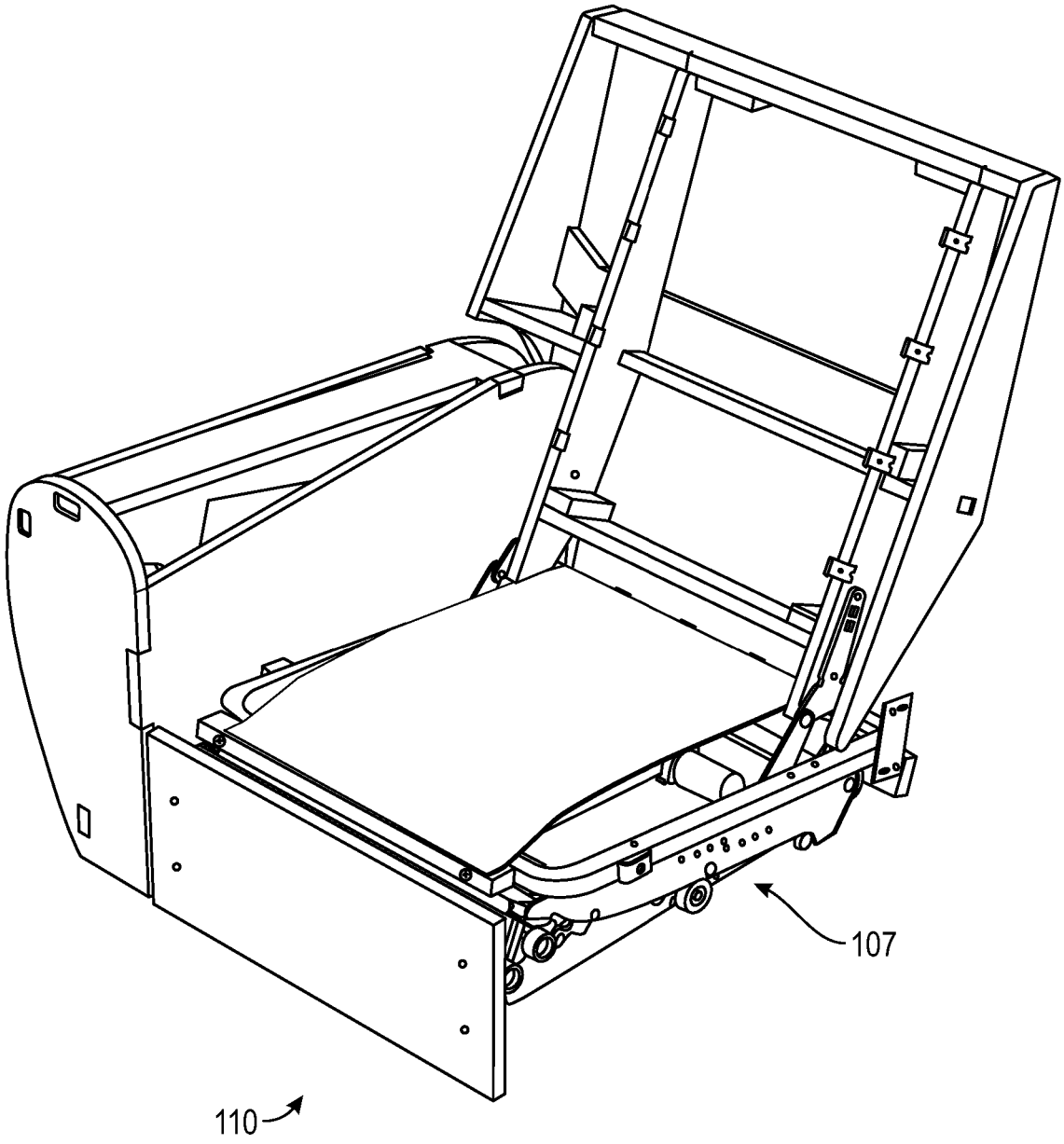

The present invention will now be described by way of example only with reference to the accompanying drawings, in which:

FIG. 1 is a perspective view of an article of furniture in the form of a chair in a fully extended second position according to one aspect of the present invention, FIG. 2 is a side of the chair of FIG. 1 in a fully retracted first position, FIGS. 3 to 5 are perspective views of a drive mechanism of the chair of FIG. 1 in a fully extended second position, FIG. 6 is a side view of the drive mechanism of FIG. 1 in a fully retracted first position, FIG. 7 is a side view of the drive mechanism of FIG. 1 between a fully retracted first position and a fully extended second position, FIG. 8 is a side view of the drive mechanism of FIG. 1 in a fully extended second position, FIG. 9 is a perspective view of an alternative chair with the drive mechanism of FIGS. 1 to 8.

Figure 10:
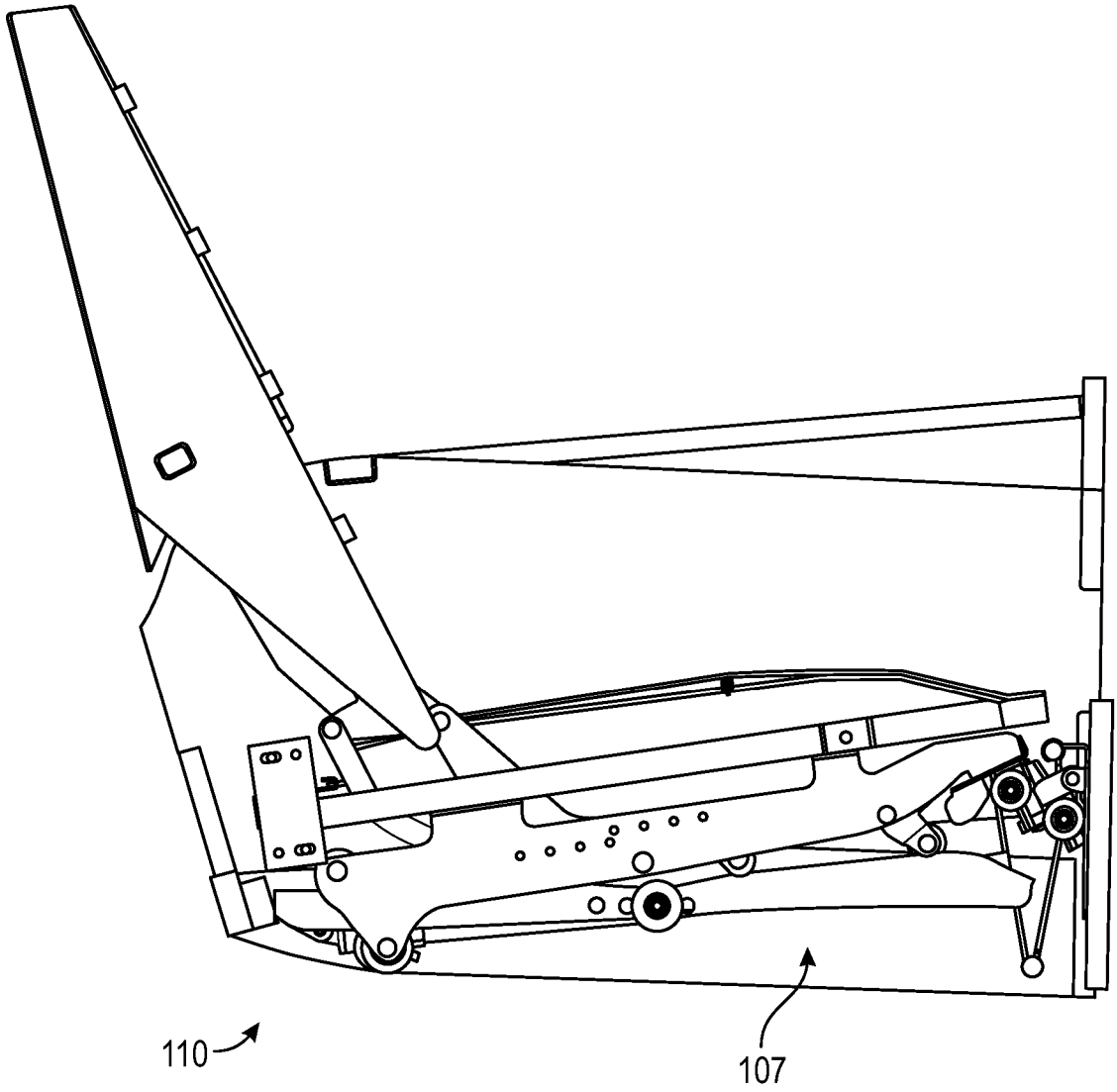
Figure 11:
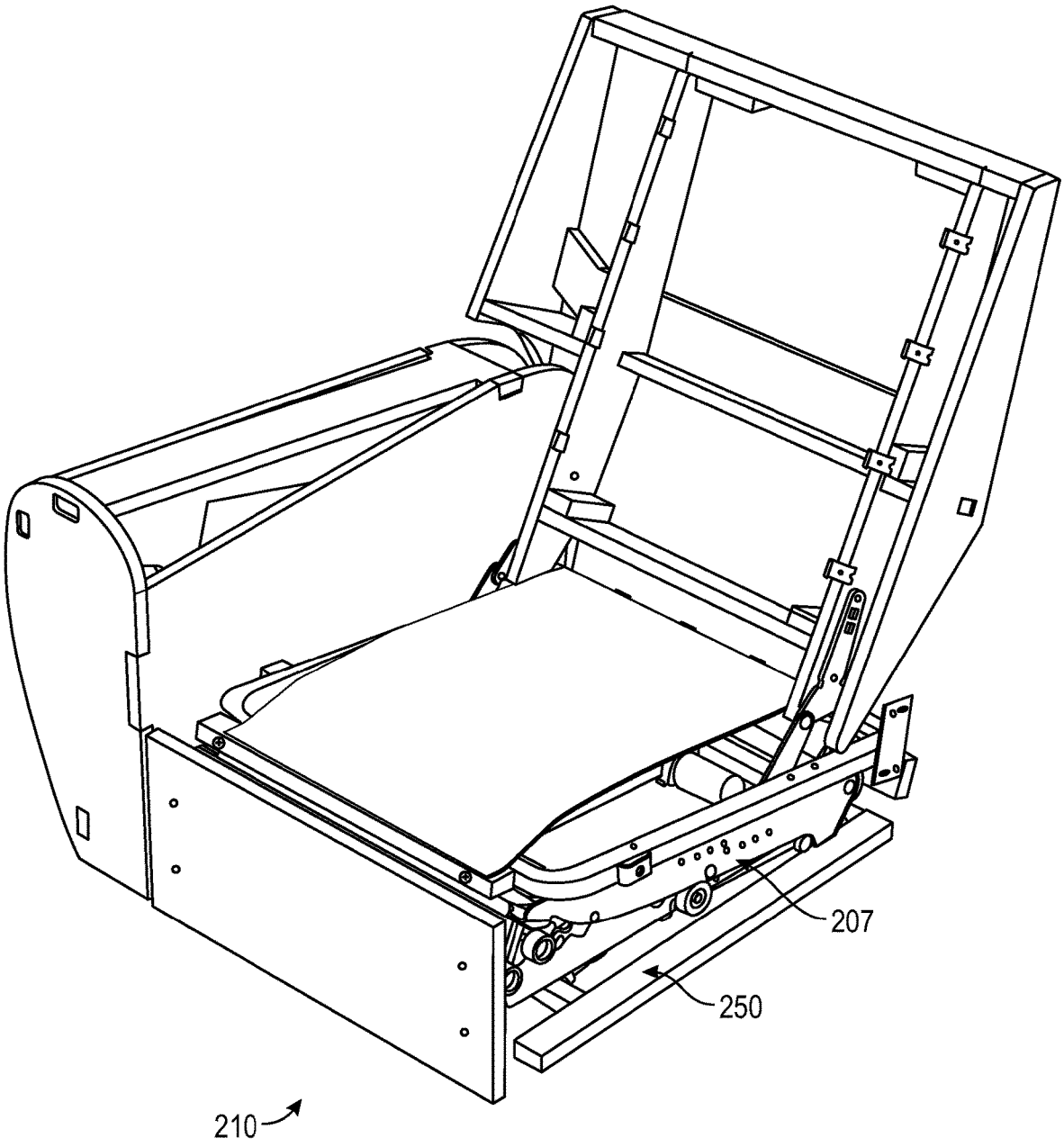
Figure 12:
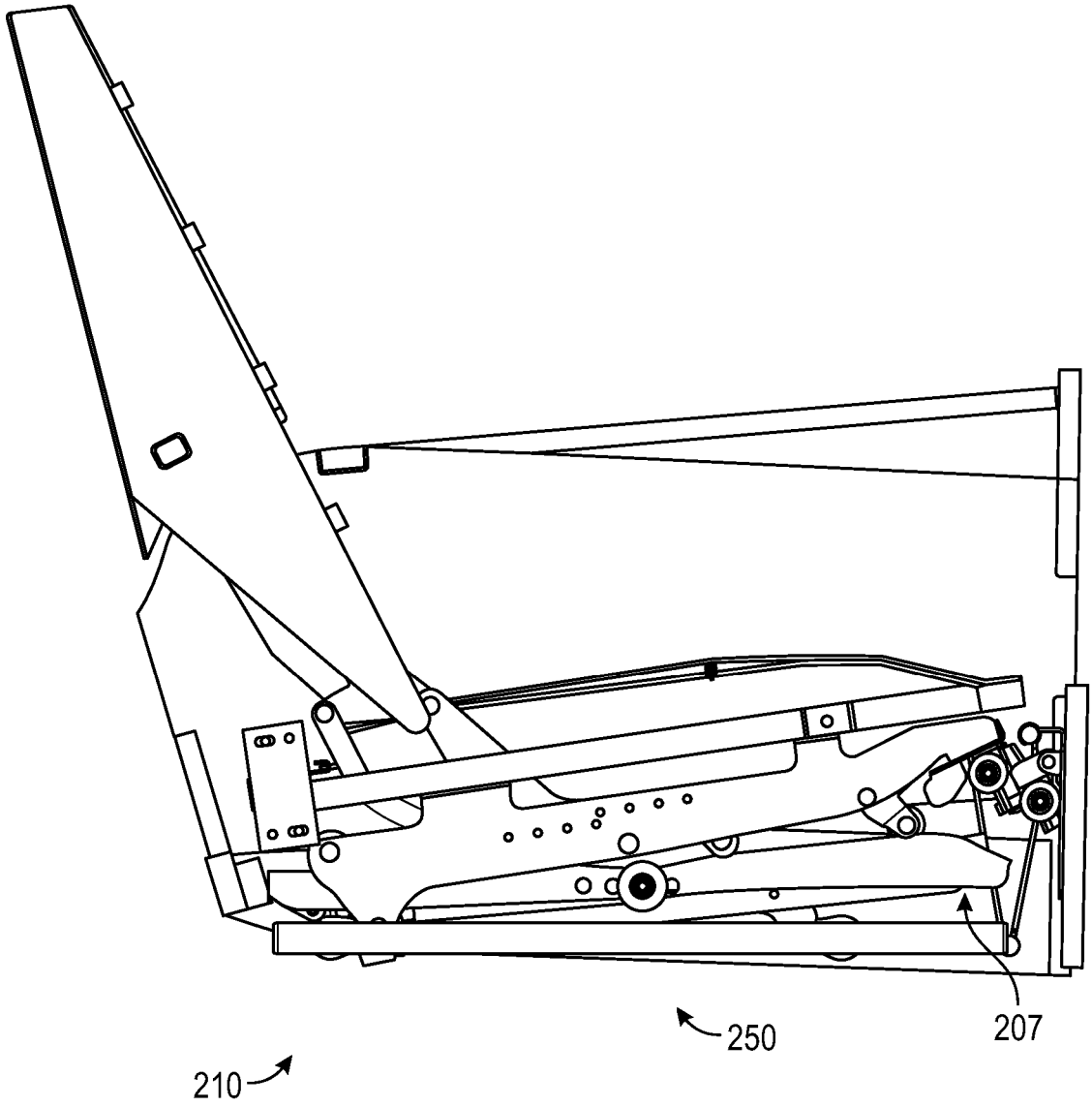
Figure 13:
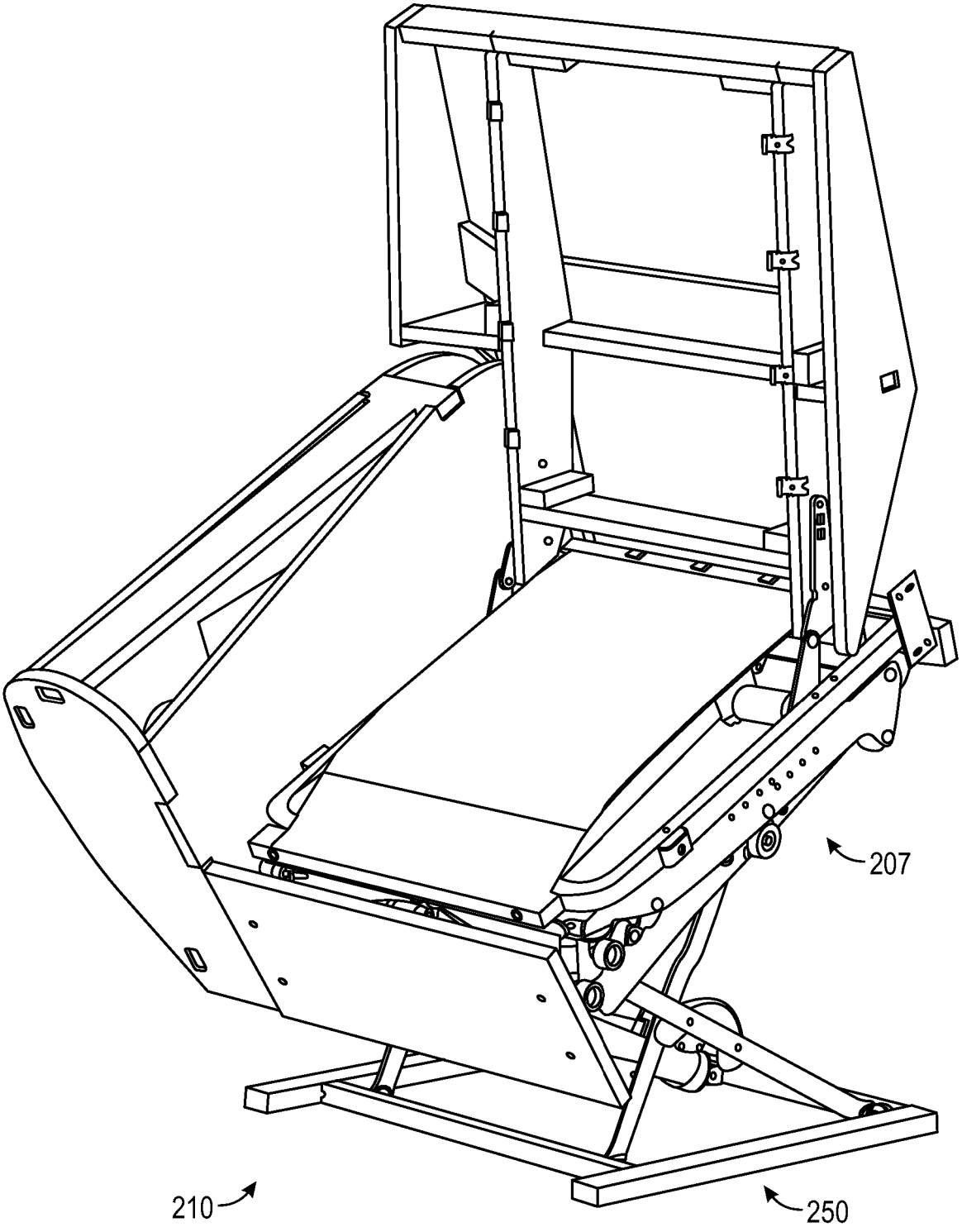
Figure 14:
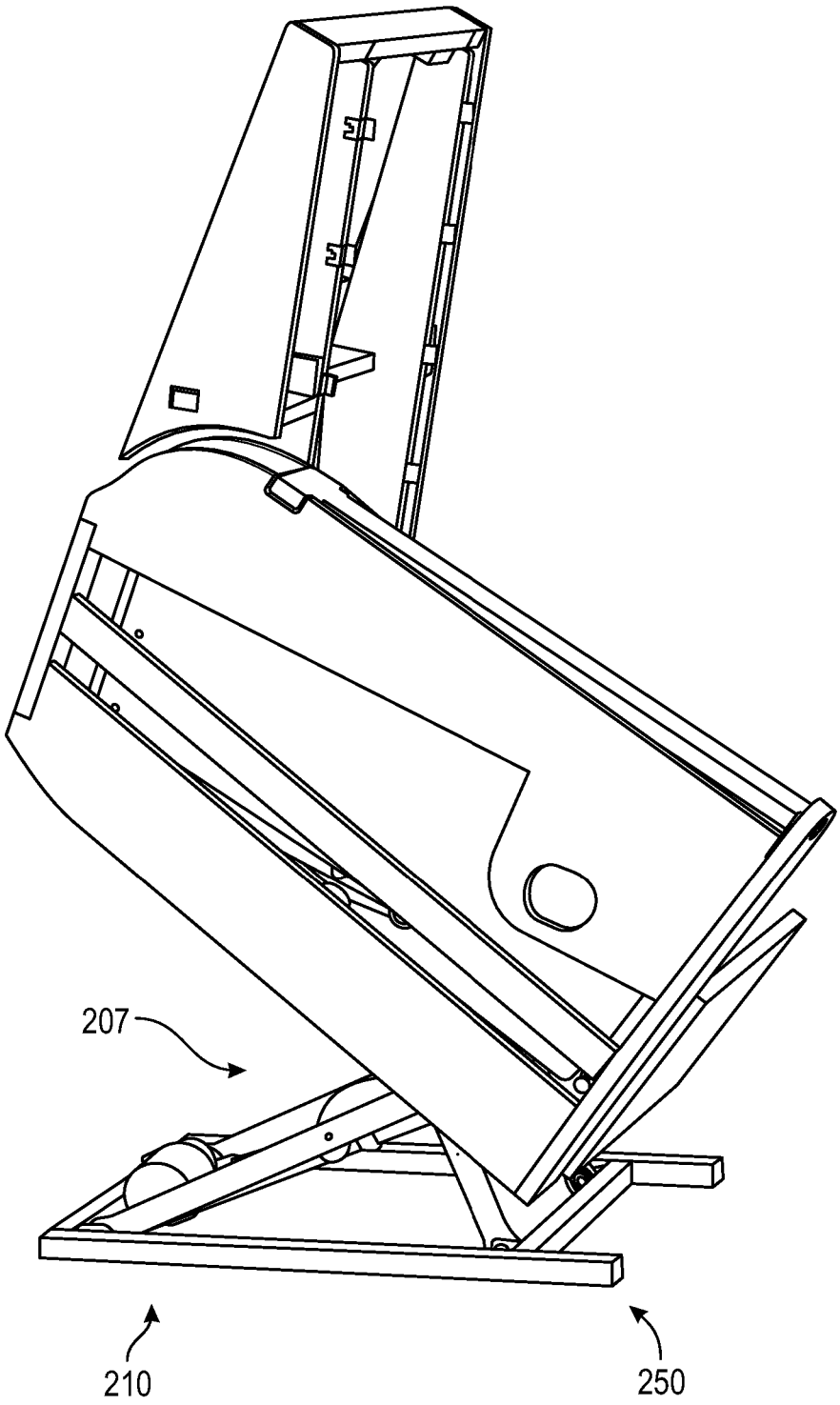

FIG. 10 is a side view of an alternative chair with the drive mechanism of FIGS. 1 to 8.

Figure 15:
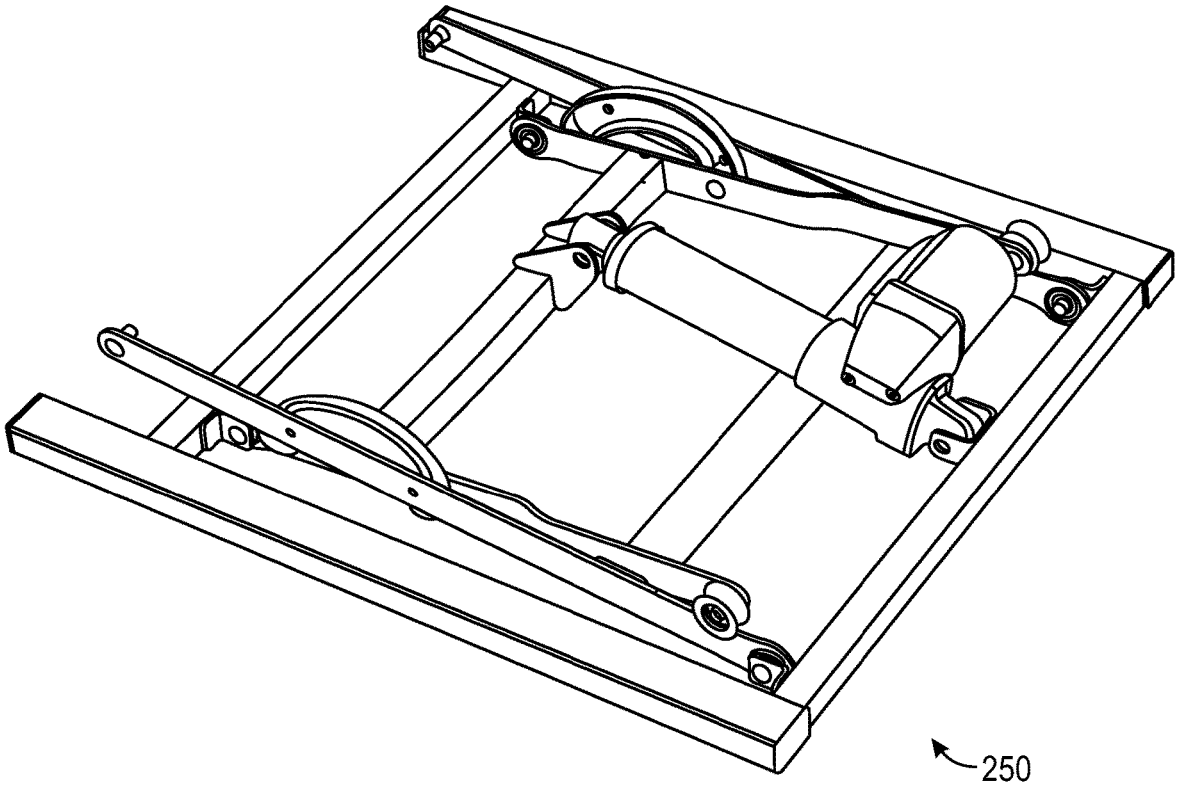
Figure 16:
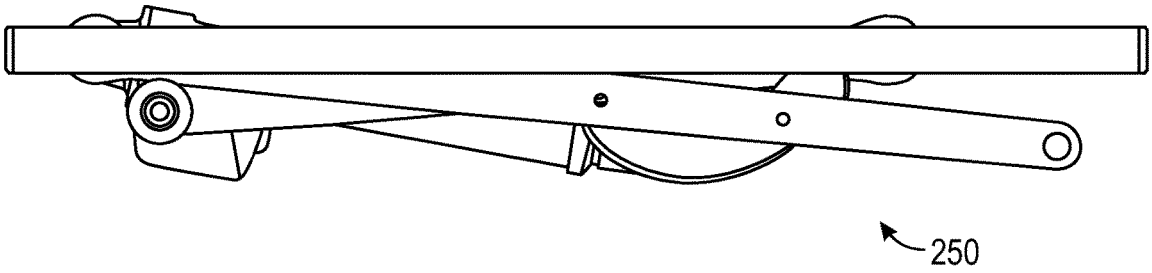
Figure 17:
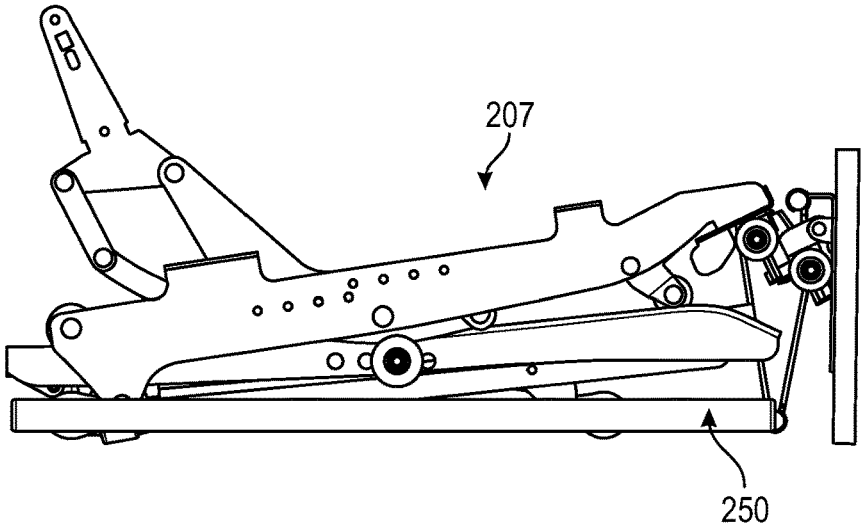
Figure 18:
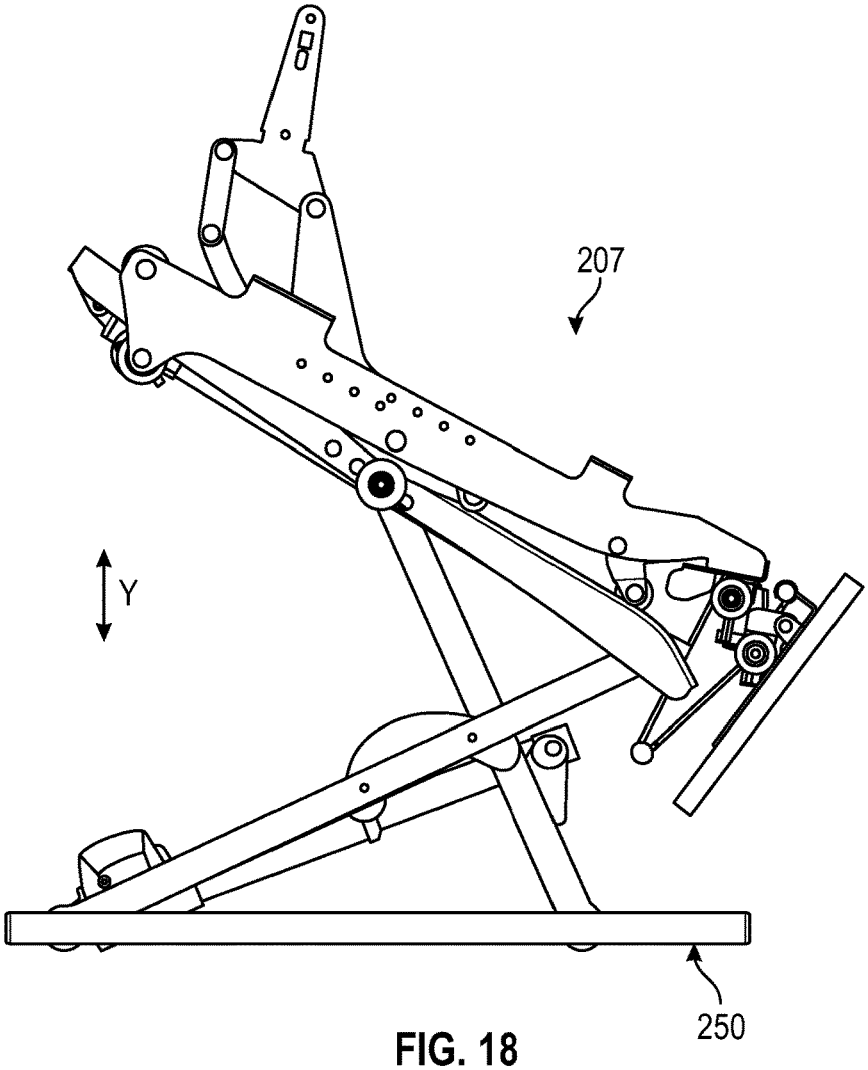
Figure 19:
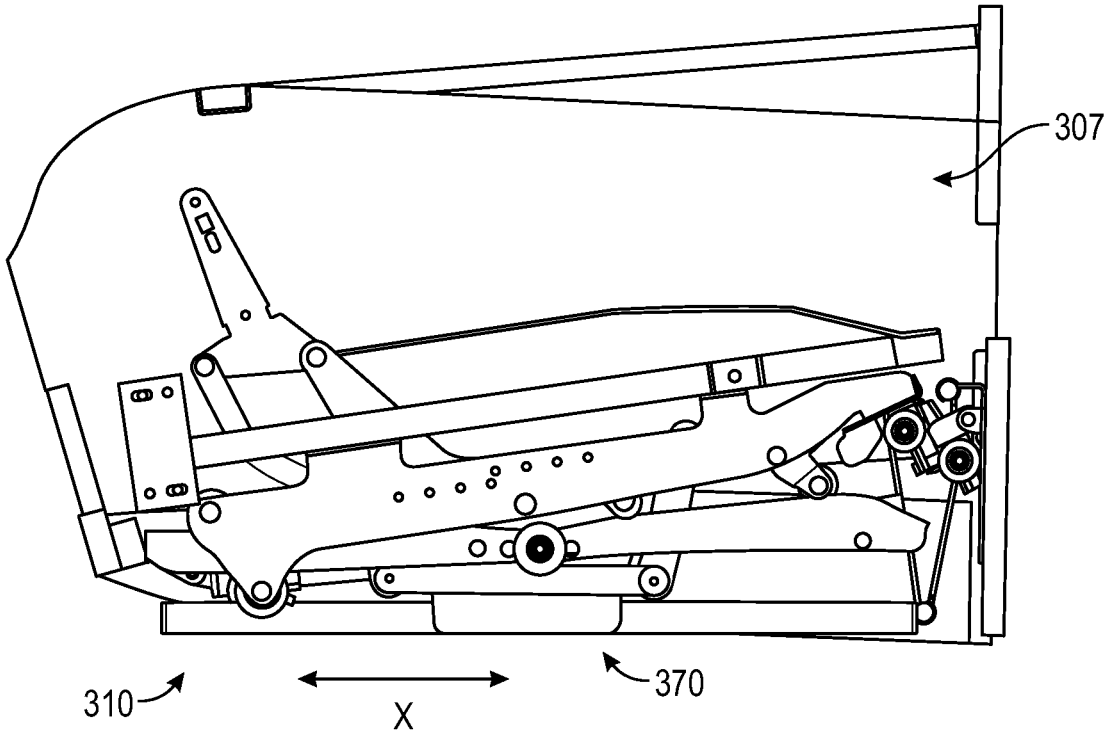
Figure 20:
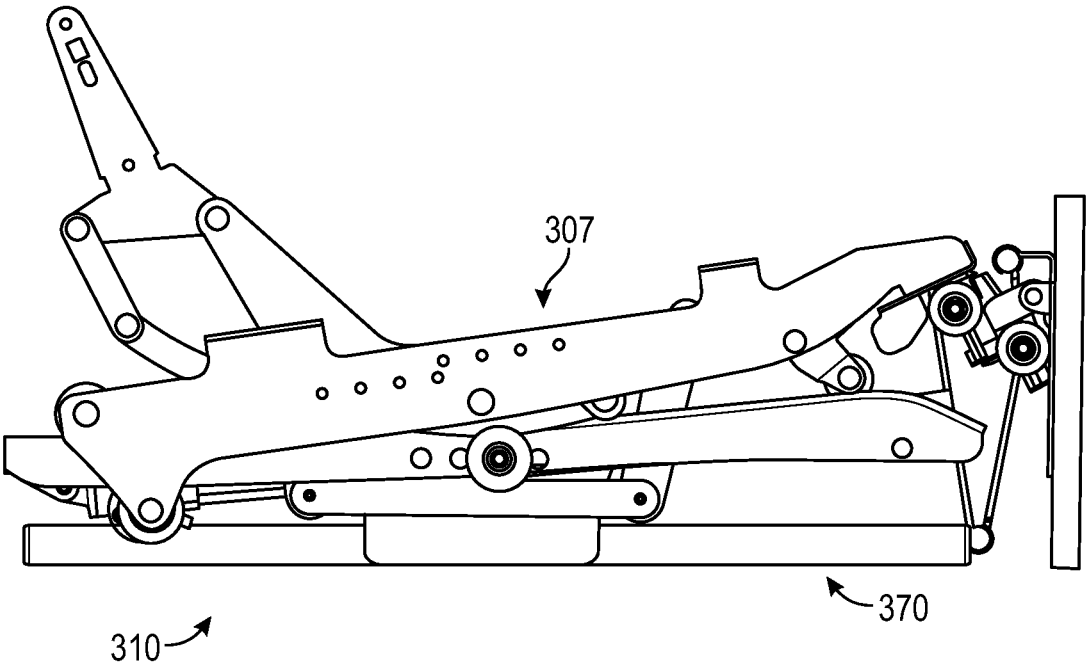
Figure 21:
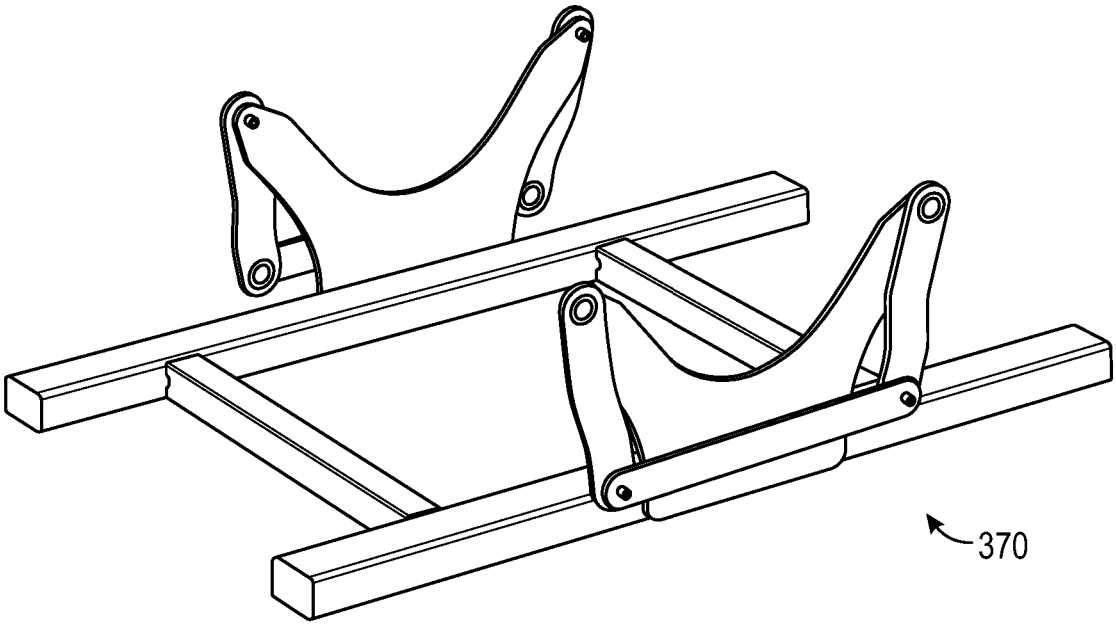

FIGS. 11 to 14 are different view of the chair of FIG. 10 incorporating a lift mechanism, FIGS. 15 and 16 are alternative views of the lift mechanism of FIGS. 11 to 14, FIGS. 17 and 18 are side views of the drive mechanism of FIG. 1 in the chair of FIGS. 11 to 14 in the lowered and raised configurations, FIG. 19 is a side view of the chair of FIG. 10 incorporating a glider mechanism, FIG. 20 is a side view of the drive mechanism of FIG. 1 in chair of FIG. 19, and FIG. 21 is a perspective view of the glider mechanism of FIG. 19.

With reference to FIGS. 1 to 8, an article of adjustable furniture in the form of a chair (10), in this embodiment, a high-leg chair, comprises a drive mechanism (7) having a base section (11), and a plurality of support sections in the form of a back support (13), a first support section in the form of a seat support (12) and a second support section in the form of a footrest (14). It will be understood that the back support (13) is shown without a frame onto which a panel (not shown) is attached, the panel including an integral or separate cushioned support (not shown). The footrest (14) includes a panel (17) which includes a cushioned supported (not shown). The seat support (12) includes a support frame (19), onto which a cover panel (21) is attached. The cover panel (21) can also include an integral or separate cushioned support (not shown). The chair (10) also includes side arms (27).

The seat support (12) includes guide wheels (23) which cooperate with side arms (25) of the base section (11) to enable the seat support (12) to move relative to the base section (11) and provide both reclining and zero-wall functionality.

The chair (10) further comprises an actuator mechanism in the form of a single electric linear drive actuator (16), a connecting mechanism (18), and a drive arm (26).

The connecting mechanism (16) comprises a pair of first arms (20) and second arms (22). The first arms are pivotally connected to the seat support (12) at a first arm pivot point (42). The first arm (20) extends beyond the first arm pivot point (42) to define a first arm extension section (44). The first arm extension section (44) has a wheel (46) at its free end.

The first arm (20) is pivotally connected to the second arm (22) at a connecting arm pivotal connection (24). The connecting mechanism (18) further comprises a block (40) which is pivotally connected to the footrest (12) at a pivotal connection 39. The block (40) pivots relative to the footrest (14) about a first axis ($A_1$). The second arm (22) is pivotally connected to the block (40) at a second arm pivotal connection (34). The second arm (22) pivots relative to the block (40) about a second axis ($A_2$). The first ($A_1$) and second ($A_2$) axis are arranged relative to each other so as to enable the coordinated movement of the footrest as described further below.

The second arm (22) is therefore pivotally connected to the footrest (14) by being pivotally connected to the block (40) which is itself pivotally connected to the footrest (14). The second arm (24) extends beyond the second arm pivotal connection (34) to define a second arm extension section (36). The second arm extension section (36) has a wheel (38) at its free end.

The drive arm (26) includes a first drive arm (28) and a second drive arm (30). The first drive arm (28) is pivotally connected to the first support section (12) at a first arm pivotal connection (31). The second drive arm (30) is pivotally connected to the footrest (14) at a second arm pivotal connection (33), and the first drive arm (28) is pivotally connected to the second drive arm (30) at a connecting arm pivotal connection (32).

The actuator (16) is a linear actuator of the Delta-drive type as produced by Dewert-Okin GmbH, having a first end (motor and gear box end) mounted to a cross-member (41) of the base section (11) and a second end (43) (rod) pivotally connected to the first drive arm (28) at an actuator pivotal connection (35), such that movement of the actuator (16) causes movement of the footrest (14) via the first (28) and second (30) drive arms as will be described below.

Operation of the Chair (10) is as Follows:

With power supplied to the actuator (16), movement of the actuator (16) causes the first drive arm (28) to pivot about connecting arm pivotal connection (32), which in turn causes the second drive arm (28) to pivot and move or push the footrest (14) forwards via the second arm pivotal connection (33) from a first fully retracted position (FIG. 6) towards a second fully extended position (FIG. 8). It can be seen from FIGS. 5 to 7 that, as the footrest (14) moves forwards, the pivotal connection (32) moves upwards in the direction of arrow (Y). It can also be seen that the first (28) and second (30) drive arms move in a concertina-like manner when being powered by the actuator (16) between the first and second positions.

As the first (28) and second (30) drive arms move the footrest (14) forward under the power of the actuator (16) towards the second fully extended position, the first arm (20) and the second arm (22) also move in a concertina-like manner, as well as pivoting outwardly and laterally. More specifically, it can be seen that the connecting arm pivotal connection (24) extends laterally in the direction of arrow (L) and outwardly in the direction of arrow (O) (FIGS. 3 and 4). It can also be seen that a plane defined by the seat support (12) substantially coincides with a plane defined by the pivotal movement of the first (20) and second (22) arms.

As the second arm (22) pivots about the pivotal connection (24), the pivoting of the second arm (22) relative to the block (40) about the first axis ($A_1$) and the pivoting of the block (40) about the second axis ($A_2$) relative to the footrest (14), results in movement of the second arm (22) causing the footrest (14) to simultaneously move both linearly and rotationally.

As the second arm (22) pivots about the pivotal connection (24), the wheel (38) at the free end of the second arm extension (36) rotates on and engages with the underside of the footrest (14) to cause rotation of the footrest (14) as it moves between the first and second positions. At the same time, rotation and engagement of the wheel (46) at the free end of the first arm extension section (44) with the seat support (12), in conjunction with the engagement of the wheel (38) with the underside of the footrest (14) enables the seat support (12) to support the weight of an occupant on the footrest (14).

The drive arm (26) provides a triangulation effect with the first (20) and second (22) arms, to increase the rigidity of the connecting mechanism, ensure the pair of first and second arms (20),(22) extend evenly, and prevent the footrest from moving laterally relative to the seat support (12).

Connecting the actuator (16) to the footrest (12) via the first (28) and second (30) drive arms, also enables an actuator with a shorter stroke to be used.

In the first retracted position, the first (20) and second (22) arms are substantially parallel to each other, thereby providing a compact mechanism in the depth (direction X) of the chair (10).

It will be understood that the connecting mechanism (18) described above enables the footrest (14) to be driven both linearly and rotationally between first retracted and second extended positions.

It will also be understood that the connecting mechanism can be used to move any two support sections relative to each other, and is not limited to moving a seat support relative to a foot rest. For example, the connecting mechanism can move a back support relative to a seat support, or a neck support relative to a back support. It will be further understood, that the concertina-like movement between the first and second arms of the connecting mechanism is able to provide linear movement of one support section relative to another, or a combination of linear and rotational movement of one support section relative to another.

In FIGS. 9 and 10, an alternative chair (110) is provided which is identical to the chair of FIGS. 1 to 8, except that instead of being a high-leg chair, the chair (110) has no legs.

The chair (110) includes a drive mechanism (107) which is identical to the drive mechanism of FIGS. 1 to 8.

In FIGS. 11 to 18, an alternative chair (210), identical to the chair of FIGS. 9 and 10, incorporates a drive mechanism (207) which is identical to the drive mechanism of FIGS. 1 to 8, and a second mechanism in the form of a lift mechanism (250) as shown in FIGS. 15 and 16. The lift mechanism (250) is releasable attachable to the drive mechanism (207), and further operable to provide functionality to raise and lower the drive mechanism (207) relative to the floor upon which the chair is positioned in the direction of arrow Y. FIG. 18 shows the chair (210) in a lowered configured, and FIG. 19, in a raised configuration.

In FIGS. 19 to 21, an alternative chair (310), identical to the chair of FIGS. 9 and 10, incorporates a drive mechanism (307) which is identical to the drive mechanism of FIGS. 1 to 8, and a second mechanism in the form of glider mechanism (350) as shown in FIG. 21. The glider mechanism (350) is releasable attachable to the drive mechanism (307), and further operable to provide functionality to allow the drive mechanism (307) to glide relative to the floor upon which the chair is positioned in the direction of arrow X.

It will be understood that the compact nature of the drive mechanism in the height direction (arrow Y) and depth direction (arrow X) provides space to enable the attachment of the second mechanisms and still be able to retain the seat support at a desirable height with adequate cushioning, and enough space below the seat support so that if the chair includes legs extending below the seat support, the second mechanism is not visible below the seat support.

It will also be understood that whilst the above embodiments have been described in relation to an adjustable chair, the drive mechanism can also be applied to other furniture, for example, a bed with multiple support sections.

The invention claimed is:

1. A drive mechanism (7) for an article of adjustable furniture (10), the drive mechanism (7) comprising: a plurality of support sections, said support sections including a first support section (12) and a second support section (14), an actuator mechanism (16), and at least one connecting mechanism (18), the at least one connecting mechanism (18) includes a first arm (20) pivotally connected to the first support section (12), and a second arm (22) pivotally connected to the second support section (14), the first arm (20) being pivotally connected to the second arm (22), wherein the actuator mechanism (16) is drivingly connected to the second support section (14) to effect a concertina-like movement between the first arm (20) and the second arm (22) to move the second support section (14) relative to the first support section (12), wherein: the concertina-like movement between the first arm (20) and the second arm (22) causes one of a relative linear and a rotational movement between the first (12) and second (14) support sections; and wherein: the concertina-like movement between the first aim (20) and the second aim (22) causes coordinated simultaneous linear and rotational movement of the second support section (14) relative to the first support section (12).

2. The drive mechanism (7) according to claim 1 wherein: the concertina-like movement between the first arm (20) and the second arm (22) causes coordinated simultaneous linear and rotational movement of the second support section (14) relative to the first support section (12).

3. The drive mechanism (7) according to claim 1, wherein: the second arm extension section (36) having a wheel (38) at its free end, wherein the wheel (38) engages with the second support section (14).

4. The drive mechanism (7) according to claim 1 further comprising: a block (40) pivotally attached to the second support section (14), wherein the second arm (22) is pivotally connected to the block (40) such that the second arm (22) is pivotally connected to the second support section (14).

5. The drive mechanism (7) according to claim 4 wherein: the second arm (22) pivots relative to the block (40) about a first axis, and the block (40) pivots relative to the second support section (14) about a second axis, the first and second axis arranged relative to each other such that pivoting of the second arm (22) relative to the block (40) about the first axis and pivoting of the second support section (14) relative to the block (40) about the second axis enables the concertina-like movement between the first arm (20) and the second arm (22) to cause the coordinated simultaneous linear and rotational movement of the second support section (14) relative to the first support section (12).

6. The drive mechanism (7) according to claim 1 wherein: the first arm (20) and the second arm (22) pivot substantially parallel to a plane defined by the first support section.

7. The drive mechanism (7) according to claim 1 wherein: the first arm (20) and the second arm (22) pivot in a lateral (L) direction as the actuator mechanism (16) drives the second support section (14) from a first retracted position towards a second extended position.

8. The drive mechanism (7) according to claim 1 wherein: the first arm (20) and the second arm (22) are connected at a connecting arm pivotal connection (24), and the connecting arm pivotal connection (24) moves in an outward (O) direction as the actuator mechanism (16) drives the second support section (14) from a first retracted position towards a second extended position.

9. The drive mechanism (7) according to claim 1 wherein: the first (20) and second (22) arms are substantially parallel when the second support section (14) is in a first retracted position.

10. The drive mechanism (7) according to claim 1 wherein: at least one of first support section is a seat section and the second support section is a foot rest, the first support section is a back rest section and the second support section is a neck support section, and the first support section is a seat section and the second support section is a lumbar support section.

11. An article of furniture (10,110,210,310), comprising: a drive mechanism (7,107,207,307) according to claim 1.

12. A drive mechanism (7) for an article of adjustable furniture (10), the drive mechanism (7) comprising: a plurality of support sections, said support sections including a first support section (12) and a second support section (14), an actuator mechanism (16), and at least one connecting mechanism (18), the at least one connecting mechanism (18) includes a first arm (20) pivotally connected to the first support section (12), and a second arm (22) pivotally connected to the second support section (14), the first arm (20) being pivotally connected to the second arm (22), wherein the actuator mechanism (16) is drivingly connected to the second support section (14) to effect a concertina-like movement between the first arm (20) and the second arm (22) to move the second support section (14) relative to the first support section (12);

further comprising: a drive arm (26) connecting the first (12) and second (14) support sections, wherein the actuator mechanism (16) is pivotally connected to the drive arm (26) to drivingly connect the actuator mechanism to the second support section (14); and wherein: the drive arm (26) comprises a first drive arm (28) and second drive arm (30), the first drive arm (28) is pivotally connected to the first support section (12) at a first drive arm pivotal connection (31), the second drive arm (30) is pivotally connected to the second support section (14) at a second arm pivotal connection (33), and the first drive arm (28) is pivotally connected to the second drive arm (30) at a connecting arm pivotal connection (32), such that movement of the actuator mechanism (16) effects concertina-like movement between the first drive arm (28) and second drive arm (30) when the second support section (14) moves relative to the first support section (12).

13. The drive mechanism (7) according to claim 12 wherein: the connecting arm pivotal connection (32) moves in an upward (Y) direction as the actuator mechanism (16) drives the second support section (14) from a first retracted position towards a second extended position.

14. The drive mechanism (7) according to claim 12 wherein: the actuator mechanism (16) is pivotally connected to the first drive arm (28) part-way along the first drive arm (28) between the first drive arm pivotal connection (31) and the connecting arm pivotal connection (32).

15. A drive mechanism (7) for an article of adjustable furniture (10), the drive mechanism (7) comprising: a plurality of support sections, said support sections including a first support section (12) and a second support section (14), an actuator mechanism (16), and at least one connecting mechanism (18), the at least one connecting mechanism (18) includes a first arm (20) pivotally connected to the first support section (12), and a second arm (22) pivotally connected to the second support section (14), the first arm (20) being pivotally connected to the second arm (22), wherein the actuator mechanism (16) is drivingly connected to the second support section (14) to effect a concertina-like movement between the first arm (20) and the second arm (22) to move the second support section (14) relative to the first support section (12), wherein: the first arm (20) is pivotally connected to the first support section (12) at a first arm pivot point (42) to define a first arm extension section (44), wherein the concertina-like movement between the first arm (20) and the second arm (22) engages the first arm extension section (44) with the first support section (12) to support the second support section (14) relative to the first support section (12).

16. The drive mechanism (7) according to claim 15, wherein: the first arm extension section (44) has a wheel (46) at its free end, wherein the wheel (46) engages with the first support section (12).

* * * * *